US006900599B2

(12) United States Patent
Ribarich

(10) Patent No.: US 6,900,599 B2
(45) Date of Patent: May 31, 2005

(54) ELECTRONIC DIMMING BALLAST FOR COLD CATHODE FLUORESCENT LAMP

(75) Inventor: Thomas J. Ribarich, Laguna Beach, CA (US)

(73) Assignee: International Rectifier Corporation, El Segundo, CA (US)

( * ) Notice: Subject to any disclaimer, the term of this patent is extended or adjusted under 35 U.S.C. 154(b) by 0 days.

(21) Appl. No.: 10/104,318

(22) Filed: Mar. 21, 2002

(65) Prior Publication Data

US 2002/0141129 A1 Oct. 3, 2002

Related U.S. Application Data

(60) Provisional application No. 60/277,635, filed on Mar. 22, 2001.

(51) Int. Cl.[7] ..... H05B 41/16

(52) U.S. Cl. ..... 315/247; 315/272; 315/209 R; 315/291; 315/DIG. 4

(58) Field of Search ..... 315/291, 307, 315/224, 246, 247, 276, 209 R, 200 R, DIG. 4, 274, 225, 272

(56) References Cited

U.S. PATENT DOCUMENTS

| | | | | |
|---|---|---|---|---|
| 5,394,064 A | | 2/1995 | Ranganath et al. | 315/209 |
| 5,583,402 A | | 12/1996 | Moisin et al. | 315/307 |
| 5,604,411 A | * | 2/1997 | Venkita subrahmanian et al. | 315/307 |
| 5,747,942 A | * | 5/1998 | Ranganath | 315/224 |
| 5,900,700 A | * | 5/1999 | Arndt et al. | 315/291 |
| 6,008,593 A | * | 12/1999 | Ribarich | 315/307 |
| 6,031,338 A | * | 2/2000 | Yoon et al. | 315/209 R |
| 6,031,342 A | | 2/2000 | Ribarich et al. | 315/291 |
| 6,040,661 A | * | 3/2000 | Bogdan | 315/224 |
| 6,054,815 A | * | 4/2000 | Sugita et al. | 315/244 |
| 6,144,360 A | * | 11/2000 | Evanicky et al. | 345/102 |
| 6,259,215 B1 | | 7/2001 | Roman | 315/307 |
| 6,329,786 B1 | * | 12/2001 | Ono | 320/113 |
| 6,362,575 B1 | * | 3/2002 | Chang et al. | 315/224 |
| 6,452,344 B1 | * | 9/2002 | MacAdam et al. | 315/307 |
| 6,462,941 B1 | * | 10/2002 | Hulick et al. | 361/683 |
| 6,469,453 B2 | * | 10/2002 | Tajika et al. | 315/199 |
| 6,486,616 B1 | * | 11/2002 | Liu et al. | 315/291 |
| 6,496,236 B1 | * | 12/2002 | Cole et al. | 349/61 |
| 6,509,696 B2 | * | 1/2003 | Bruning et al. | 315/246 |
| 6,642,674 B2 | * | 11/2003 | Liao et al. | 315/291 |
| 2003/0179577 A1 | * | 9/2003 | Marsh | 362/260 |

OTHER PUBLICATIONS

International Search Report dated Aug. 5, 2002.

* cited by examiner

*Primary Examiner*—Tuyet Thi Vo
(74) *Attorney, Agent, or Firm*—Ostrolenk, Faber, Gerb & Soffen, LLP

(57) ABSTRACT

An electronic ballast for powering a cold cathode fluorescent lamp of an electronic display device comprising: a rectifier coupled to a source of AC power for producing a rectified DC output voltage, a power factor correction circuit receiving the rectified DC output voltage and providing an increased voltage DC bus voltage, an electronic switching circuit comprising at least one electronic switch for switching the DC bus voltage to provide a switched voltage for driving a cold cathode fluorescent lamp, the switched voltage being provided to the lamp through an output stage comprising a resonant LC circuit; and an electronic ballast control circuit for controlling a switching operation of the electronic switching circuit, the electronic ballast being provided in a housing for the electronic display device.

18 Claims, 15 Drawing Sheets

DC Bus and Lamp Voltage During Normal Start-up.

Lamp Voltage and Half-Bridge During Lamp Out Condition (Converter safely deactivates due to over-current).

Lamp Voltage and Half-Bridge During 100% Brightness.

Lamp Voltage and Half-Bridge
During 10% Brightness.

ELECTRONIC DIMMING BALLAST FOR COLD CATHODE FLUORESCENT LAMP

CROSS REFERENCE TO RELATED APPLICATION

This application claims the benefit and priority of provisional patent application Ser. No. 60/277,635 filed Mar. 22, 2001 entitled "DRIVER FOR COLD CATHODE FLUORESCENT LAMP", the entire disclosure of which is incorporated by reference herein.

BACKGROUND OF THE INVENTION

The present invention relates to an electronic ballast for a cold cathode fluorescent lamp. Cold cathode fluorescent lamps are typically employed, for example, as background lamps for liquid crystal displays used, for example, in personal computer displays. In the prior art, with reference to FIG. 1, a flat panel display comprising an LCD display 10 has a cold cathode fluorescent lamp behind the display to provide back lighting. A separate power supply 20 is typically employed and is connected to a source of AC power via an AC power plug 22. An interconnecting cable 24 interconnects the power supply 20 and the display 10.

The power supply 20, as shown in FIG. 2, includes an AC to DC converter which converts the input AC voltage, typically 90 to 265 volts AC 50/60 Hz, to a lower DC voltage, for example 24 volts DC. The 24 volts DC power is supplied by the interconnect cable 24 to the display 10. Internally in the display a buck converter 12 regulates the current and supplies the regulated current 14 to the Royer output stage 16, which comprises a switching circuit which provides the necessary voltage to the cold cathode fluorescent lamp (CCFL) indicated at 18. The ignition voltage is Kv. A dimming control 13 may be provided to regulate the brightness level of the CCFL 18.

It would be desirable to eliminate the external power supply as well as to reduce the size of the internal power conversion circuitry in the display to save cost, weight and space and to provide greater efficiency.

SUMMARY OF THE INVENTION

According to one aspect, the invention comprises an electronic ballast for powering a cold cathode fluorescent lamp comprising: a rectifier coupled to a source of AC power for producing a rectified DC output voltage, a power factor correction circuit receiving the rectified DC output voltage and providing an increased voltage DC bus voltage, an electronic switching circuit comprising at least one electronic switch for switching the DC bus voltage to provide a switched voltage for driving a cold cathode fluorescent lamp, the switched voltage being provided to the lamp through an output stage comprising a resonant LC circuit; and an electronic ballast control circuit for controlling a switching operation of said electronic switching circuit, said electronic ballast being provided in a housing for the electronic display device.

According to another aspect, the invention comprises an electronic ballast for powering a cold cathode fluorescent lamp comprising a rectifier coupled to a source of AC power for producing a rectified DC output voltage; a boost circuit receiving the rectified DC output voltage and providing an increased voltage DC bus voltage; an electronic switching circuit comprising at least one electronic switch for switching the DC bus voltage to provide a switched voltage for driving a cold cathode fluorescent lamp, the switched voltage being provided to the lamp through an output stage comprising a resonant LC circuit; and an electronic ballast control circuit for controlling a switching operation of said electronic switching circuit, further wherein said electronic ballast control circuit includes a dimming input, the dimming input establishing a reference phase angle and said electronic ballast control circuit further comprises a current sense input, said current sense input receiving a signal related to the actual phase angle between current through said lamp and voltage across said lamp, said electronic ballast control circuit detecting said actual phase angle and generating an error signal proportional to the difference between the actual phase angle and the reference phase angle and driving said lamp to minimize the error signal, thereby driving the lamp to a desired dimming level set by said reference phase angle.

Other features and advantages of the present invention will become apparent from the following description of the invention which refers to the accompanying drawings.

BRIEF DESCRIPTION OF THE DRAWING(S)

The present invention will be described in greater detail in the following detailed description with reference to the drawings in which.

DETAILED DESCRIPTION OF EMBODIMENTS OF THE INVENTION

Figure 1:
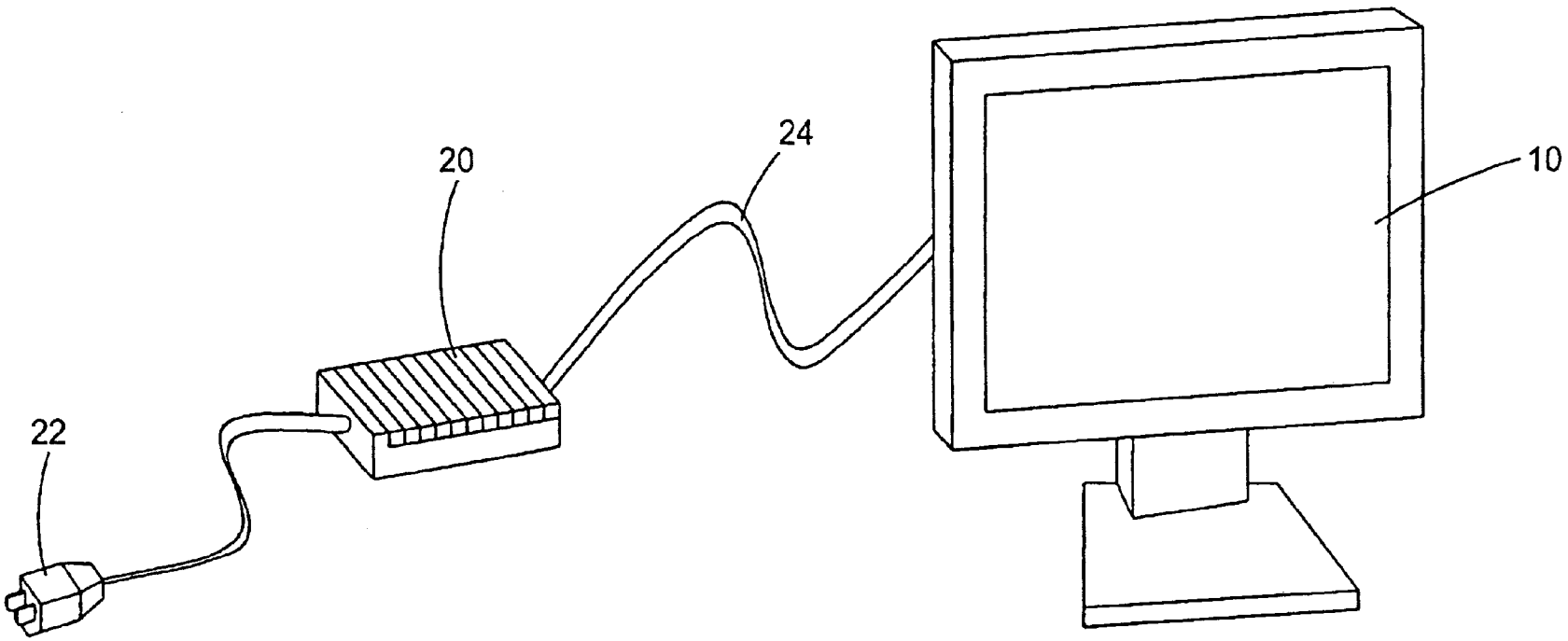
FIG. 1 PRIOR ART
FIG. 1 shows a prior art method for powering a CCFL in a desktop display.
Figure 2:
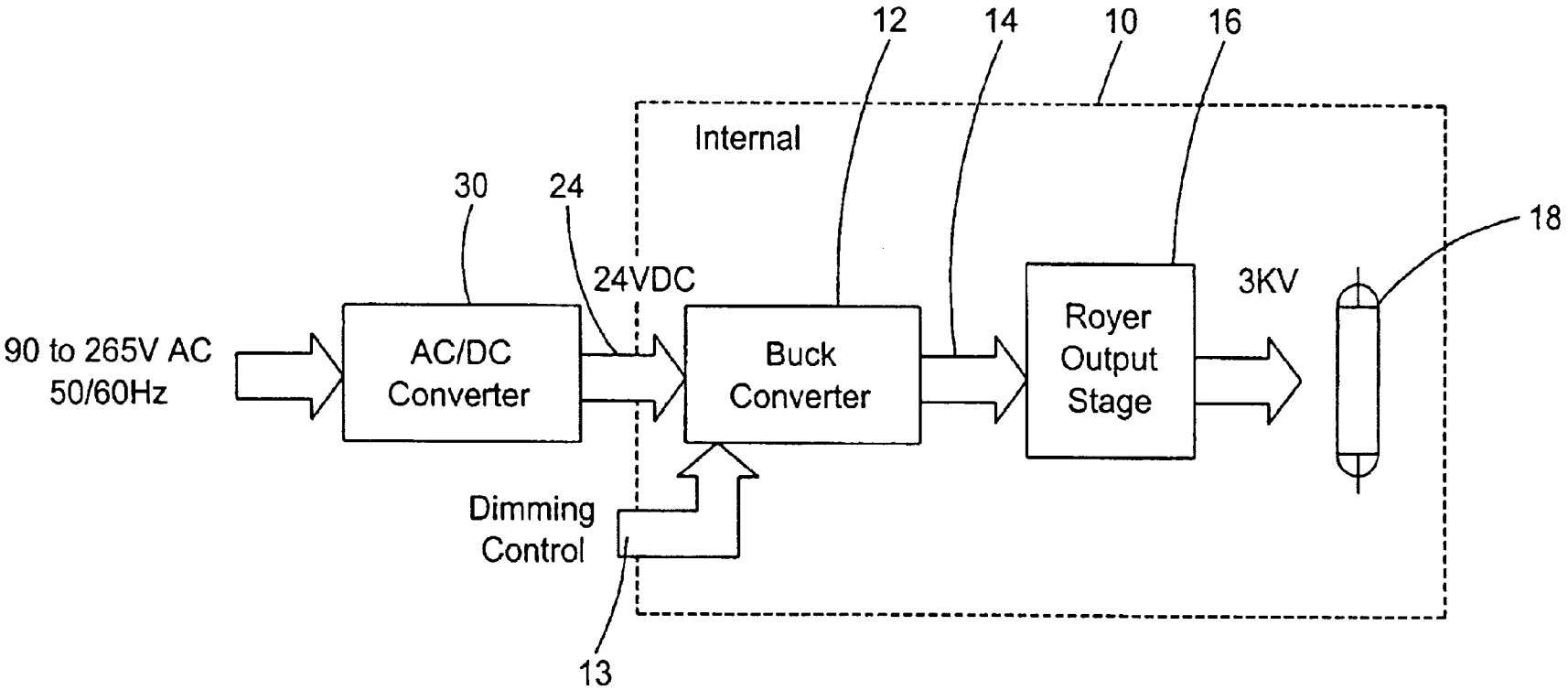
FIG. 2 PRIOR ART
FIG. 2 shows the prior art system in greater detail.
Figure 3:
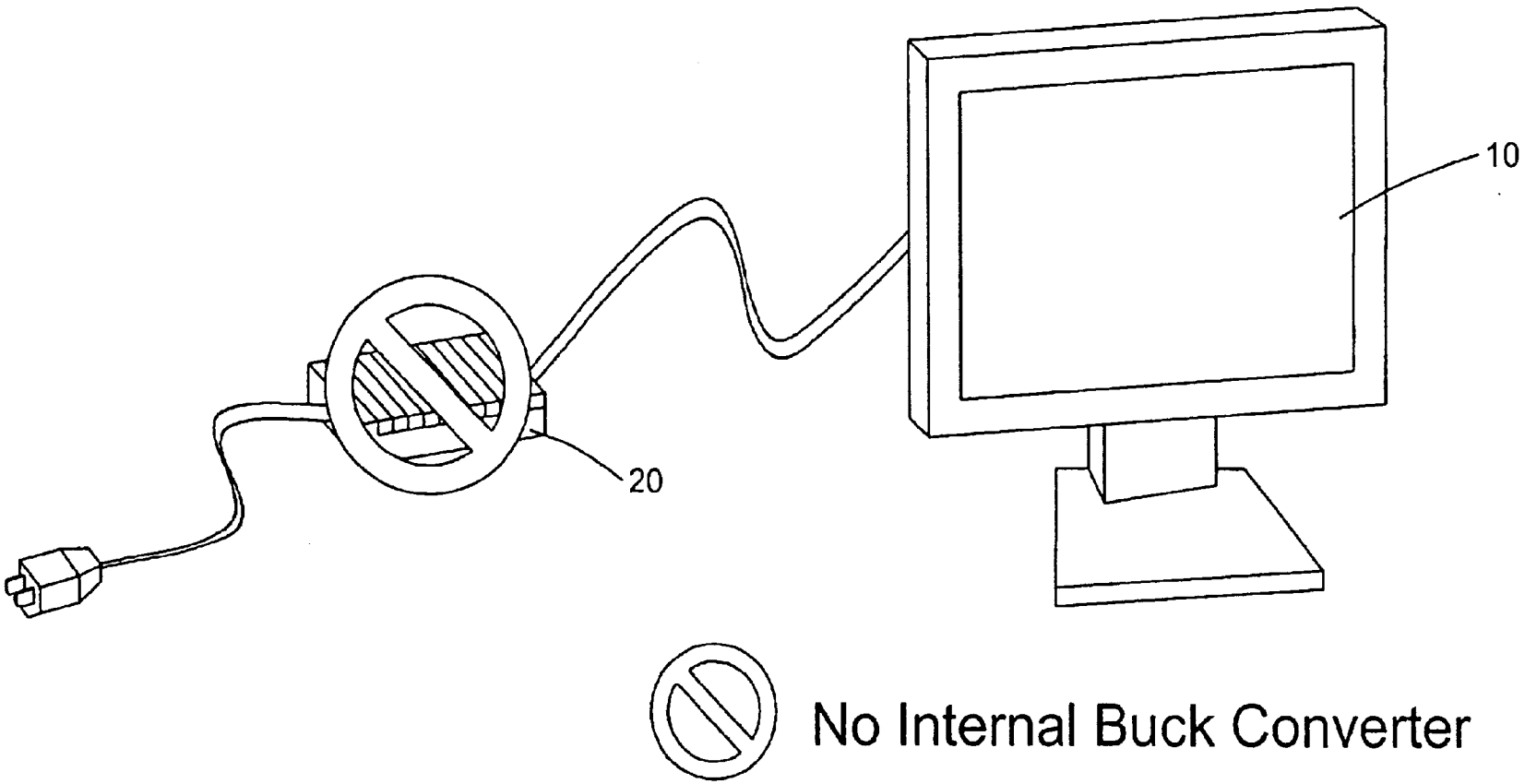
FIG. 3 shows how the present invention eliminates certain components of the prior art.
Figure 4:
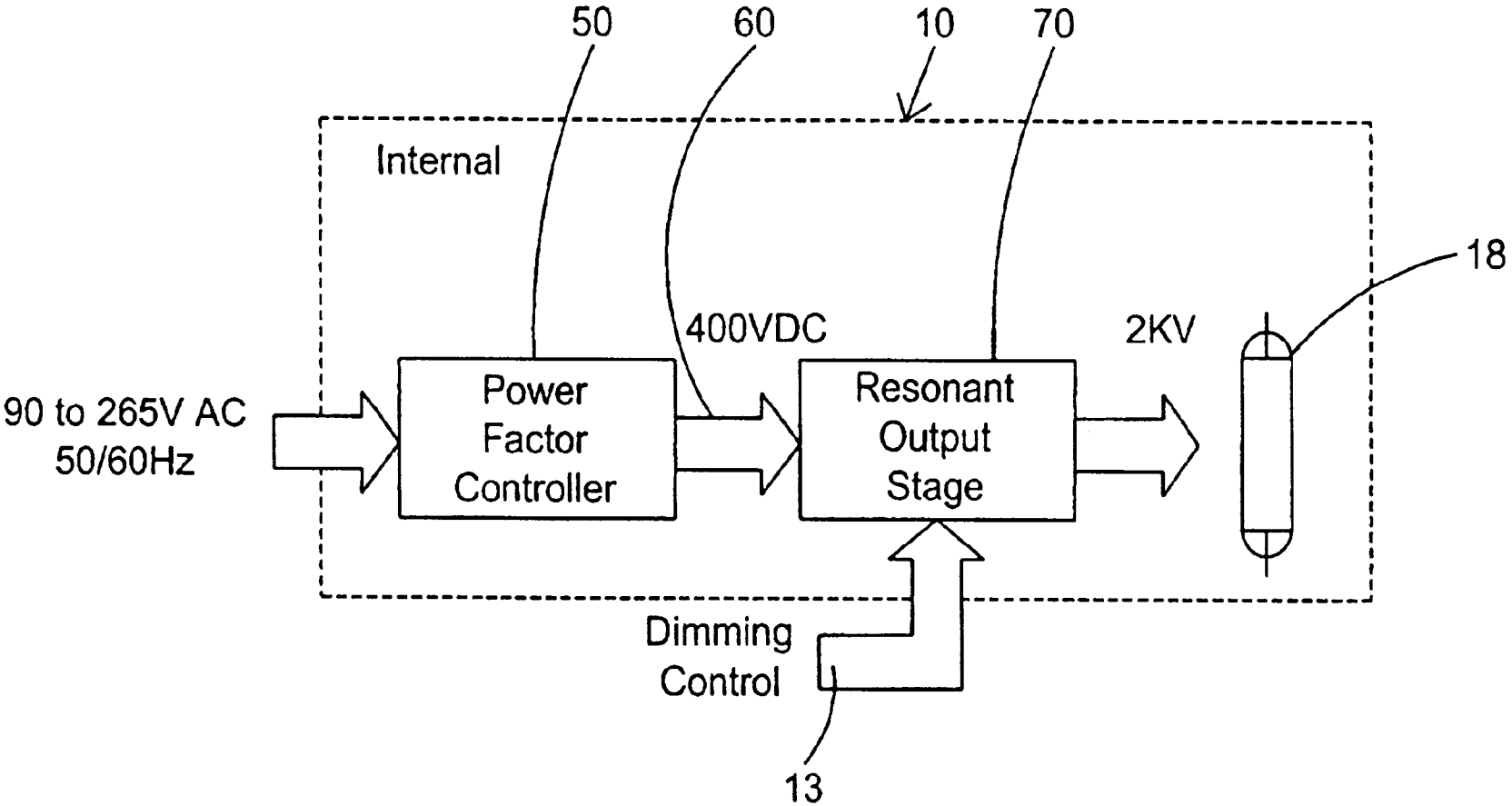
FIG. 4 shows a block diagram of the present invention.

With reference now to the drawings, and turning to FIG. 4, a basic block diagram of the invention is shown therein. In contrast to the prior art, the present invention does not require any external power supply such as the power supply 20 shown in FIG. 1. FIG. 3 shows that the invention eliminates the need for the external power supply 20 and eliminates the internal buck converter in the display 10. AC power is provided directly to the display 10. The AC power is provided through a suitable electromagnetic interference filter and rectifier stage to a power factor controller 50. The output of the power factor controller is typically 400 volts DC which is provided on a DC bus 60. The DC bus voltage is supplied to a resonant output stage 70 including a ballast control circuit driving electronic switching elements for providing a high frequency power signal through an inductive and capacitive resonant circuit to the CCFL 18. The resonant output stage 70 produces an approximate sinusoidal output voltage of 2 Kv at a high frequency, e.g., 40 to 100 KHz. Dimming control 13 is provided to achieve phase control of the phase relationship between the current and voltage provided to the CCFL 18.

Figure 5:
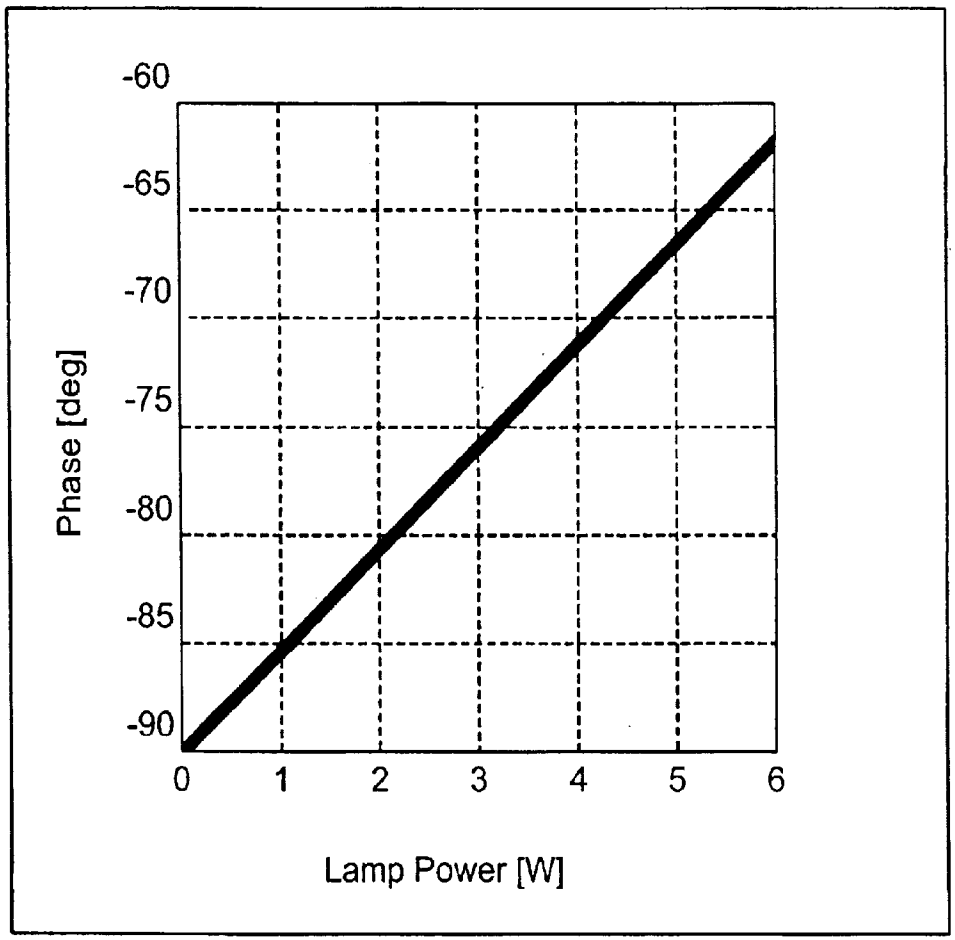
FIG. 5 shows how the lamp power varies with phase angle of current with respect to voltage provided to the lamp, thereby implementing lamp dimming.

FIG. 5 shows how phase control determines lamp power. As shown in FIG. 5, there is a linear region relating the lamp power to the phase relationship between the current and voltage provided to the CCFL. The lower the phase shift between the current end voltage provided to the lamp, the greater the power. Minimum power occurs at a phase shift of approximately 90° between current and voltage, maximum power at about 60°.

Figure 10:
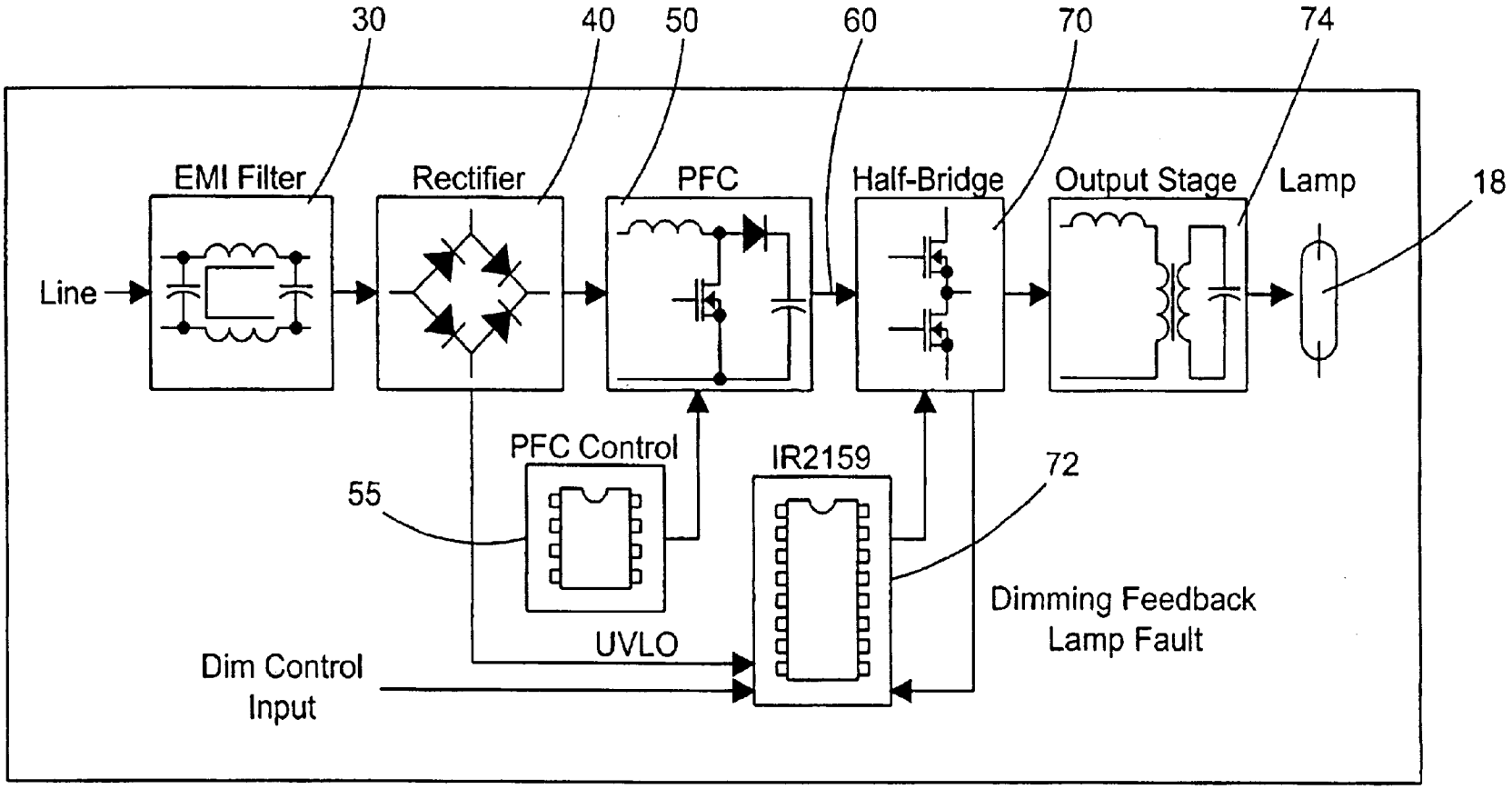
FIG. 10 is a more detailed block diagram of the invention.

Turning to FIG. 10, a more detailed block diagram of the present invention is shown. The invention includes an EMI filter 30, which includes suitable inductive and capacitive components to minimize electromagnetic interference. It is coupled to the AC line. The output of the EMI filter is provided to a rectifier stage 40, for example a full wave rectifier. The output of the rectifier 40 is provided to a power factor correction (PFC) stage 50. The power factor correction stage uses a boost converter circuit, well known to those of skill in the art, for providing an increased voltage level supplied to a DC bus 60. The power factor correction stage 50 shapes the waveform to minimize the phase shift of current and voltage at the AC input, preferably maintaining a power factor near 1, for example 0.97 to 0.99. The power factor correction stage 50 is controlled by a power factor correction controller 55, in conventional fashion. The DC bus 60 voltage is provided to an electronic switching stage 70, which has high side and low side switches controlled by control signals from a ballast controller 72. The output of the half bridge 70 is provided to an output stage 74 comprising an LC circuit forming a resonant circuit and transformer step up circuit. The CCFL 18 is coupled to the resonant output stage and is powered thereby.

Figure 6:
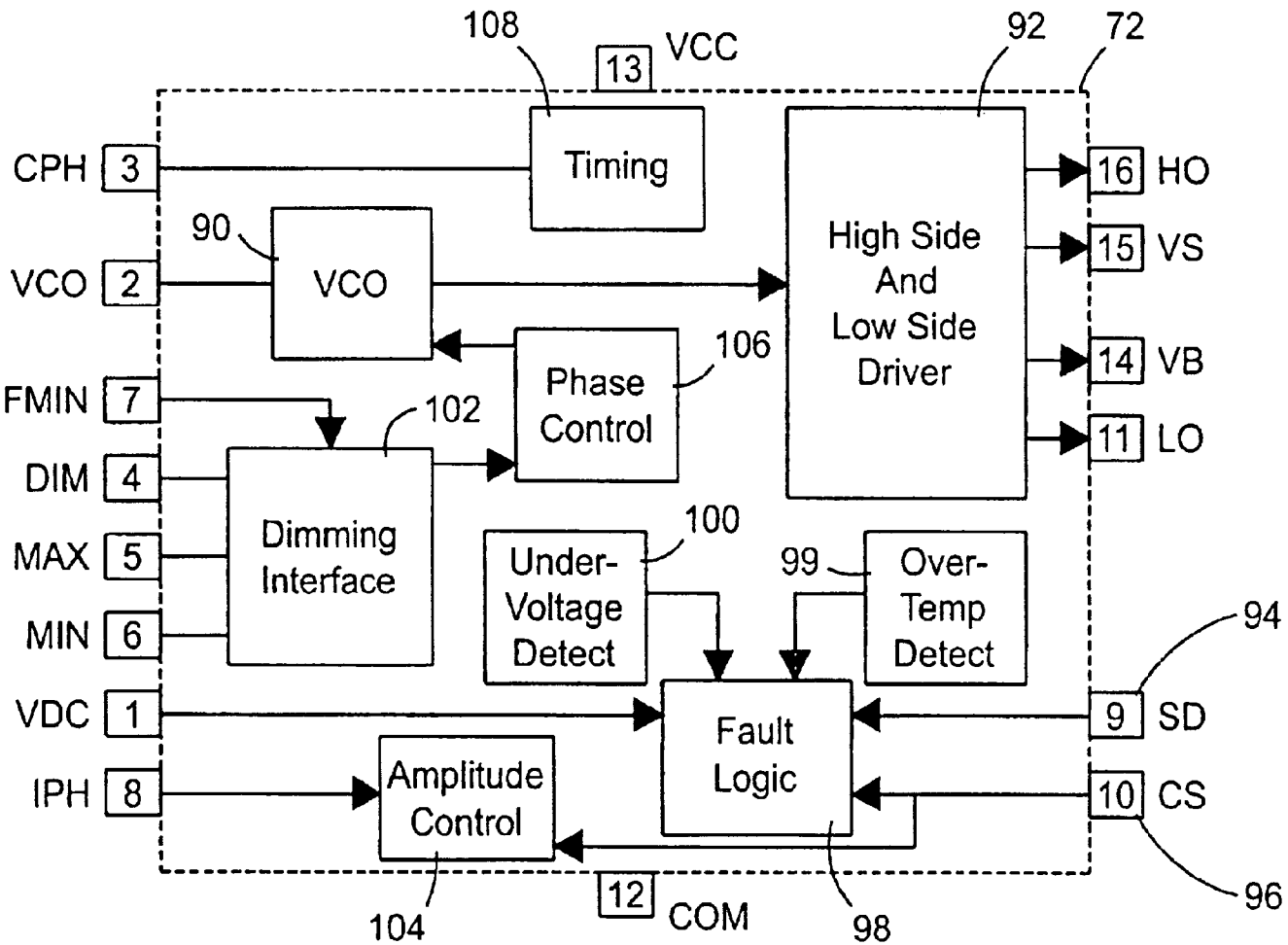
FIG. 6 is a block diagram of the ballast control device according to the present invention.

FIG. 6 shows a detailed block diagram of the half bridge controller 72. The half bridge controller may be implemented by an IR2159 ballast control IC. This circuit includes a voltage controlled oscillator 90 controlled by an input connection VCO. The output of the voltage controlled oscillator drives high and low side drivers 92 which provide high HO and low LO outputs to the half bridge electronic switches. The output from the half bridge electronic switches are taken at a common connection between the switches. The HO and LO signals are fed to the gates of the respective high and low side devices. The high and low side devices are connected in series between the DC bus.

The controller 72 further includes a shut down pin 94 and a current sense pin 96 which senses current in the half bridge circuit which is proportional to the current in the lamp. These signals are fed to fault logic 98 which can shut down the controller 72 in the event that a fault signal is applied to the shut down pin SD or an overcurrent is sensed at CS. Over-temperature detection 99 and undervoltage detection 100 are provided as inputs to the fault logic to allow shutting down the controller 72 in the event of these conditions. Input VDC is for line input voltage detection.

The controller 72 also includes a dimming interface 102 which is provided with a number of inputs including inputs by which the minimum frequency of operation, the dimming level and the maximum power or brightness levels of the lamp can be set. In addition, a peak preheat current reference IPH is provided to an amplitude control circuit 104. A preheat timing input CPH is provided to timing circuitry 108 to control the lamp preheat timing.

The dimming interface provides a reference phase to a phase control 106. The phase control receives a signal proportional to the actual phase. The actual phase is determined by detecting the zero crossing of the voltage signal proportional to the half bridge current on input CS. The zero crossing of CS is proportional to the phase angle. The phase control compares the reference phase as provided by the dimming interface and the actual phase and provides an error signal to the VCO thereby altering the VCO frequency and driving the error signal to zero. When the voltage across the lamp and current through the lamp are more closely in phase, power dissipation in the lamp and thus brightness increases. As the phase difference between voltage and current increases, power dissipation in the lamp and thus brightness decreases.

Figure 7:
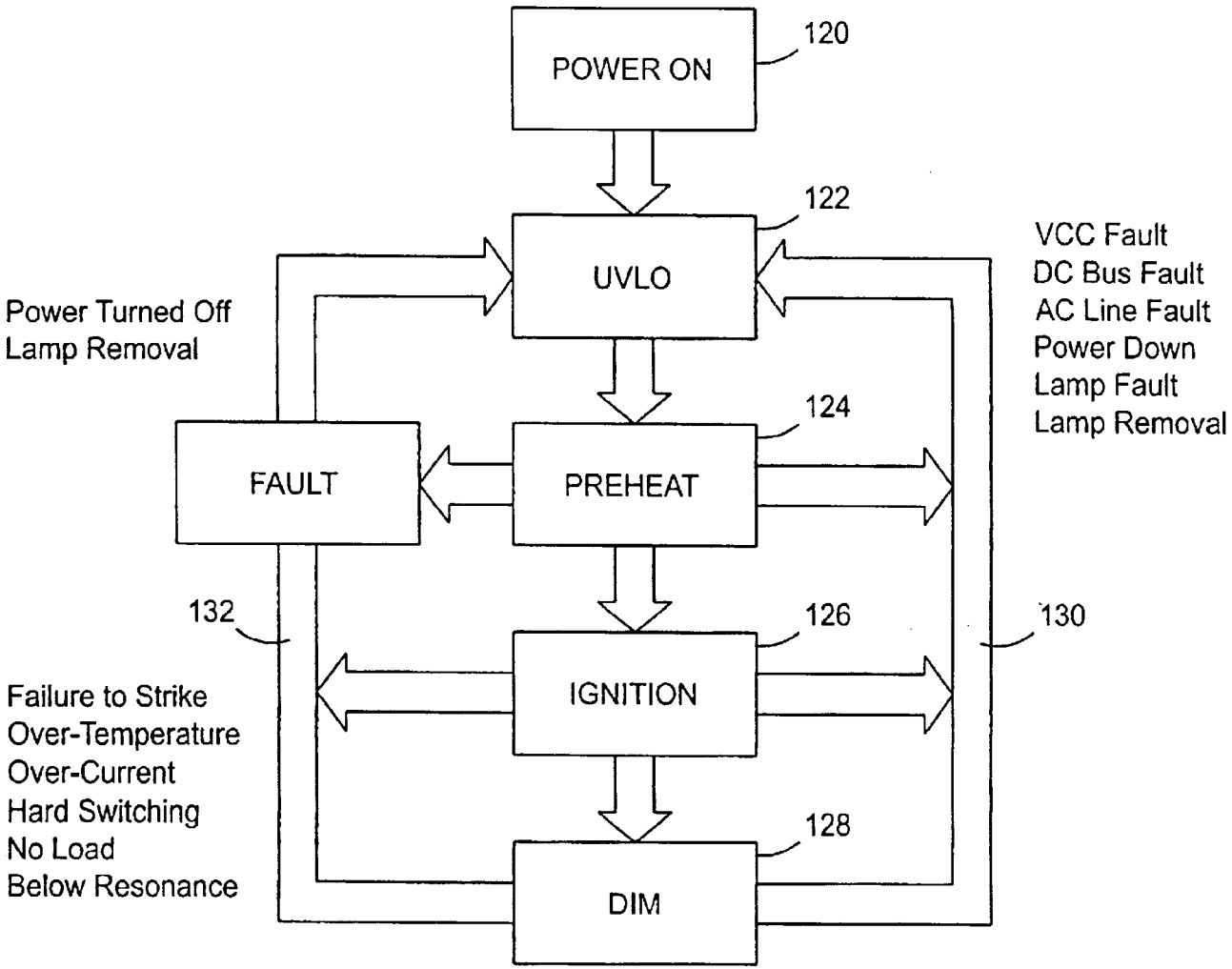
FIG. 7 is a state diagram of the ballast control device.

FIG. 7 shows the state diagram for the controller integrated circuit. At power on 120, undervoltage and lamp out (UVLO) 122 are checked. Assuming voltages are proper and the lamp is in place, the state changes to the preheat mode 124 at which the lamp is preheated. Once the lamp is preheated, ignition stage 126 is entered. Once the lamp ignites, the lamp goes into dimming mode 128 wherein the dimming level is set to the desired power level, thereby driving the lamp to the proper brightness level. During all states, preheat, ignition and dim, the controller checks for any faults or under voltage as shown by the two lines 130, 132.

Figure 8:
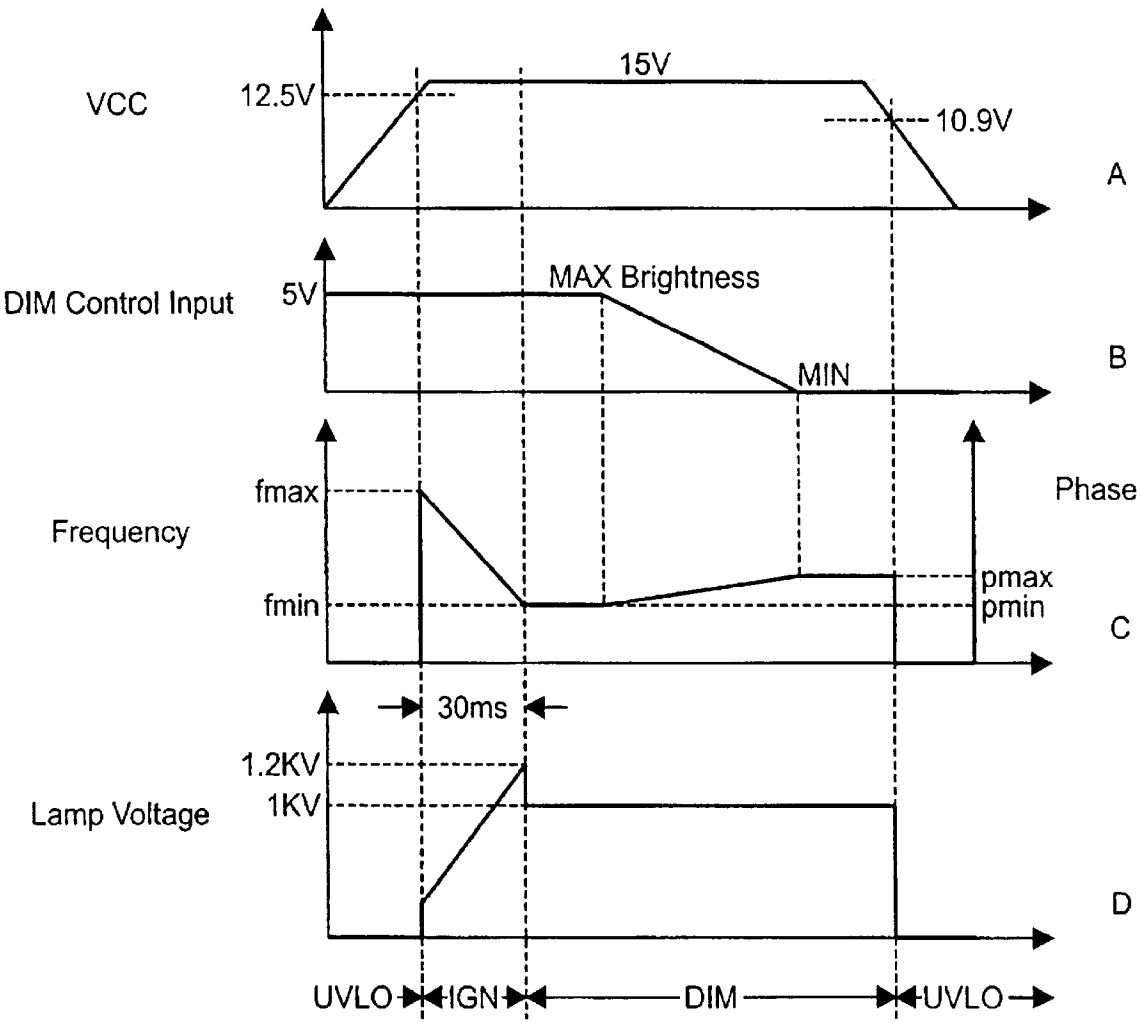
FIG. 8 shows timing waveforms of the circuit of the present invention.

FIG. 8 shows timing diagrams from start up to shut down including voltage VCC (A) which provides power to the controller integrated circuit 72, a sample dim control input (B) showing change from maximum brightness corresponding to a 5 volt DC dim input to a 0 volt DC dim input corresponding to minimum brightness. Waveform C shows the frequency of the output to the lamp upon startup during steady state and dimming. Initially, the lamp starts at a maximum frequency and ramps down to a minimum operating frequency. As shown, if a dimming signal is provided to decrease the lamp power, the frequency increases. As also shown in waveform C, as the lamp is dimmed, the phase angle between current and voltage increases from a minimum to a maximum phase difference.

Waveform D shows the lamp voltage. During ignition, the lamp voltage increases to a maximum of approximately 1.2 Kv and thereafter, once the lamp strikes, settles to an operating voltage of about 400 v peak to peak. Should undervoltage, a fault or lamp removal be detected, the half bridge is disabled by the ballast controller IC and the output voltage drops to 0.

Figure 9:
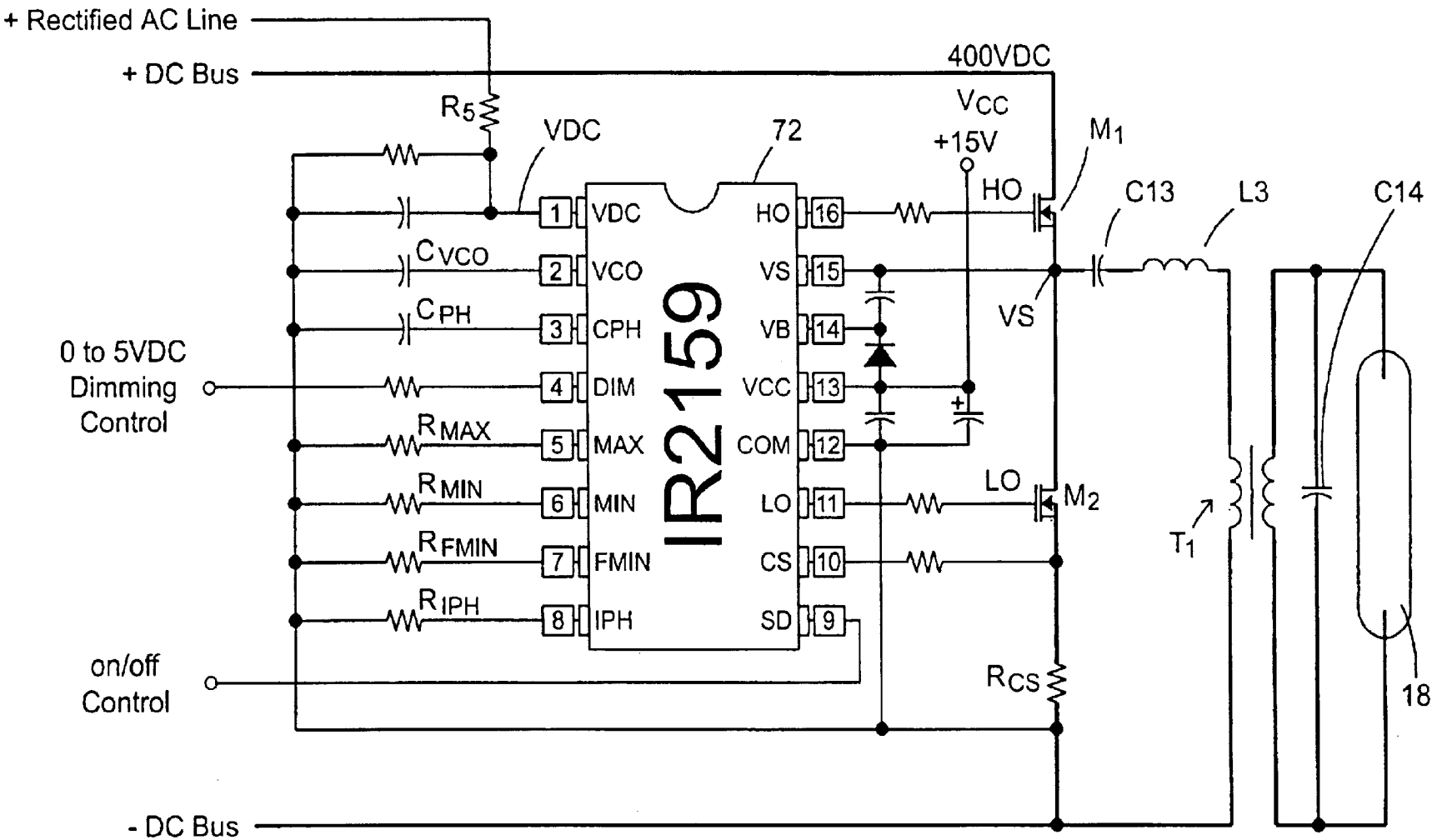
FIG. 9 shows how the ballast control device according to the present invention is connected to the output stage and the CCFL.

FIG. 9 shows a typical circuit diagram for the ballast control integrated circuit 72 driving a half bridge circuit comprising switching transistors M1 and M2. Resistor RCS provides a current sense input CS. The current through resistor RCS and thus the voltage across resistor RCS is proportional to the lamp current. In particular, the voltage at the pin CS of the controller 72 will have a zero crossing which is proportional to the phase angle of the current and voltage. Accordingly, by determining the zero crossing, the phase angle, and thus the power or brightness level of the lamp, can be determined. Feedback control of dim level can thus be achieved by comparing zero-crossing (phase angle) and a phase angle set by the dimming control. As discussed previously, an internal phase comparator compares this phase angle to a reference phase angle as set by the dimming control, and thus drives the lamp to the desired brightness level.

The various resistors RMAX, RMIN, RFMIN and RIPH set, respectively, the maximum power level, the minimum power level, minimum operating frequency and peak preheat current reference.

Capacitors CVCO and CPH set respectively, a timing control for the voltage controlled oscillator and the preheat timing.

Input voltage detection is provided at VDC via a resistor R5 connected to the rectified AC line. Power for the control IC72 is provided at VCC.

The output of the half bridge is provided at VS to a resonant circuit comprising a resonant capacitor C13, resonant inductance L3, and step up transformer T1. The secondary of transformer T1 is connected to the lamp 18. A parallel capacitance C14 is connected across the lamp 18. A peak voltage of 2 to 3 Kv is provided to the CCFL.

Figure 11:
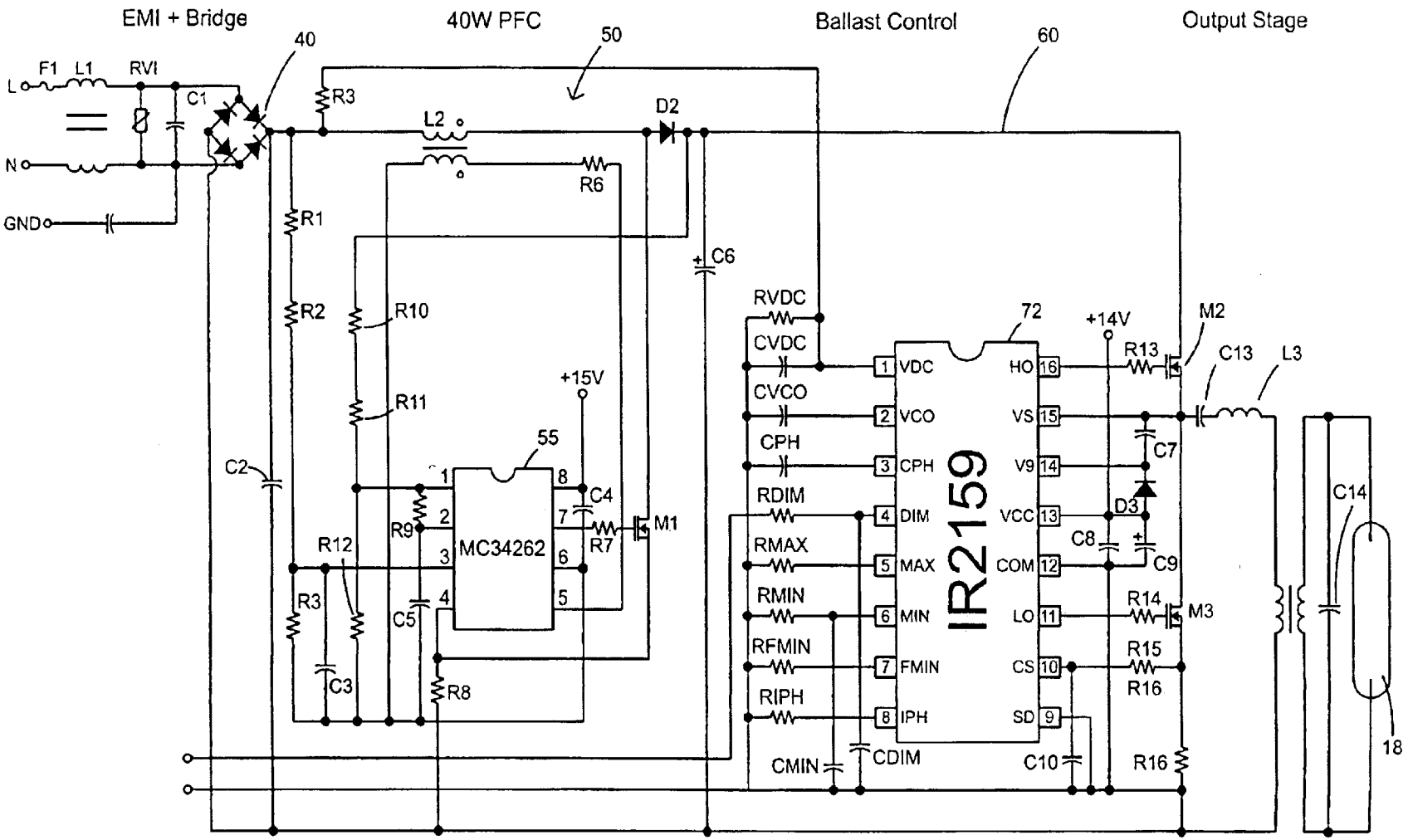
FIG. 11 is a schematic diagram of the invention of FIG. 10.

FIG. 11 shows a schematic diagram of the electronic ballast for a CCFL. The ballast control integrated circuit 72 and its associated components have been described with respect to FIG. 9. The power factor correction stage 50 is shown in more detail in FIG. 11 and includes a boost converter switching transistor M1 and a power factor correction control IC55. The power factor correction control is effective to attain a power factor of approximately 1, for example approximately 0.99. A diode D2 isolates the output of the boost converter from the DC bus 60 and allows current to be drawn from the output of the power factor correction control stage 50 when the DC bus 60 voltage drops below the output of the power factor correction stage. A filter capacitor C6 is provided on the DC bus and a filter capacitor C2 is provided at the output of the rectifier 40.

Figure 12:
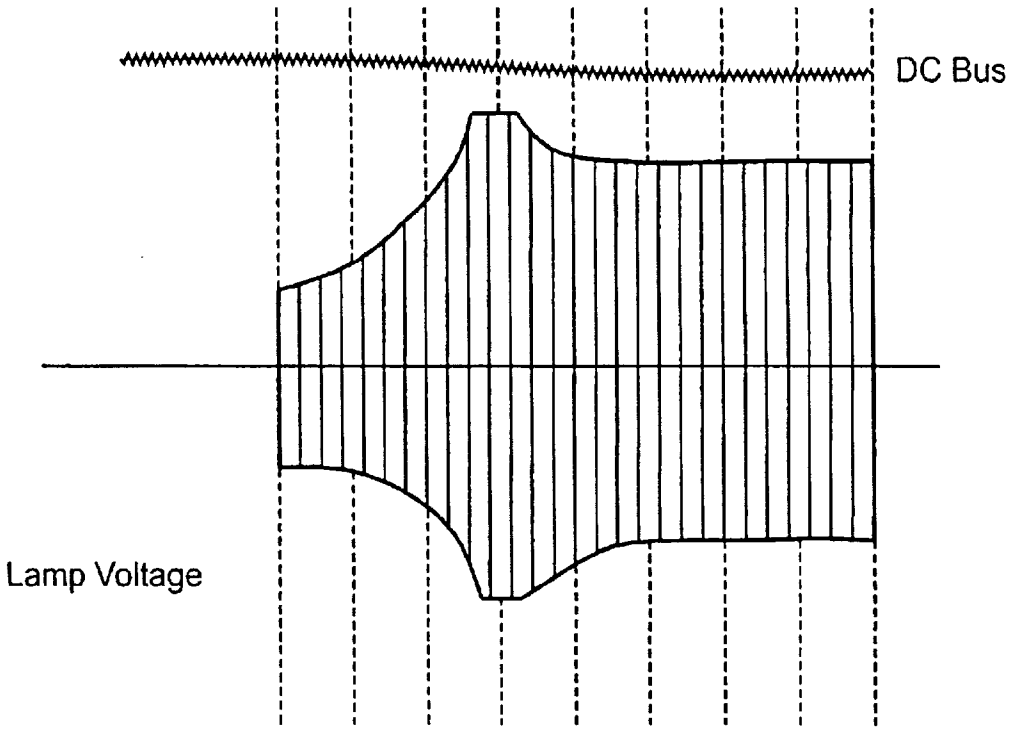
FIG. 12 shows waveforms comprising a DC bus level and lamp voltage during normal startup.

FIG. 12 shows waveforms of the DC bus 60 and the lamp voltage during a normal startup. As shown, the lamp voltage increases to a maximum voltage and then drops off to a reduced operating voltage.

Figure 13:
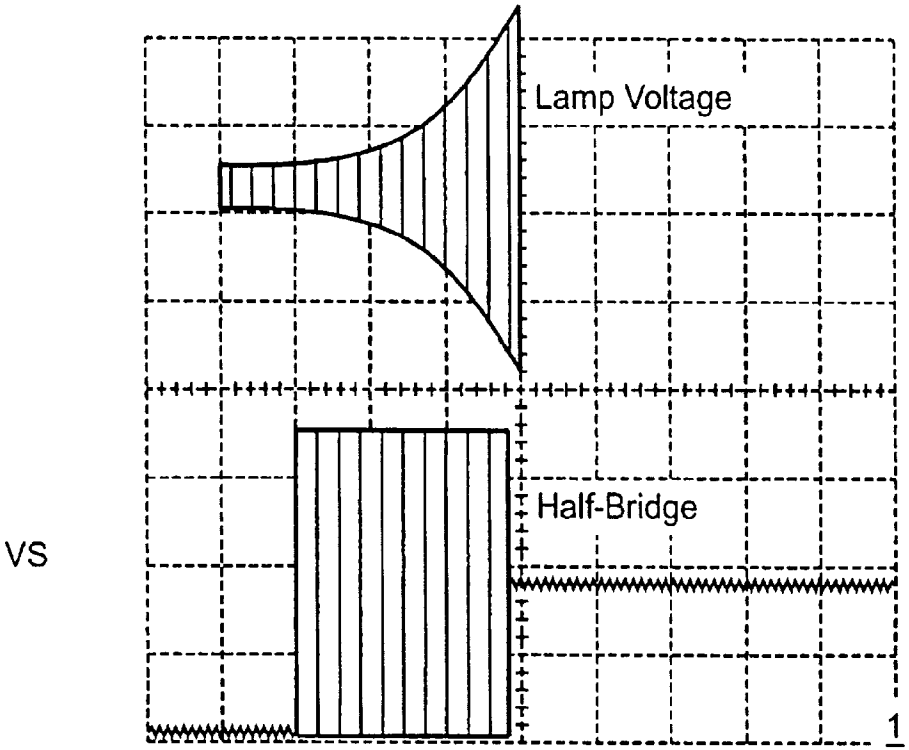
FIG. 13 shows lamp voltage and the half-bridge output voltage during a lamp out condition.

FIG. 13 shows the output voltage VS at the half bridge and the lamp voltage during a lamp out condition. As shown, the converter safely deactivates due to the over current and the output of the half bridge drops substantially to zero.

Figure 14:
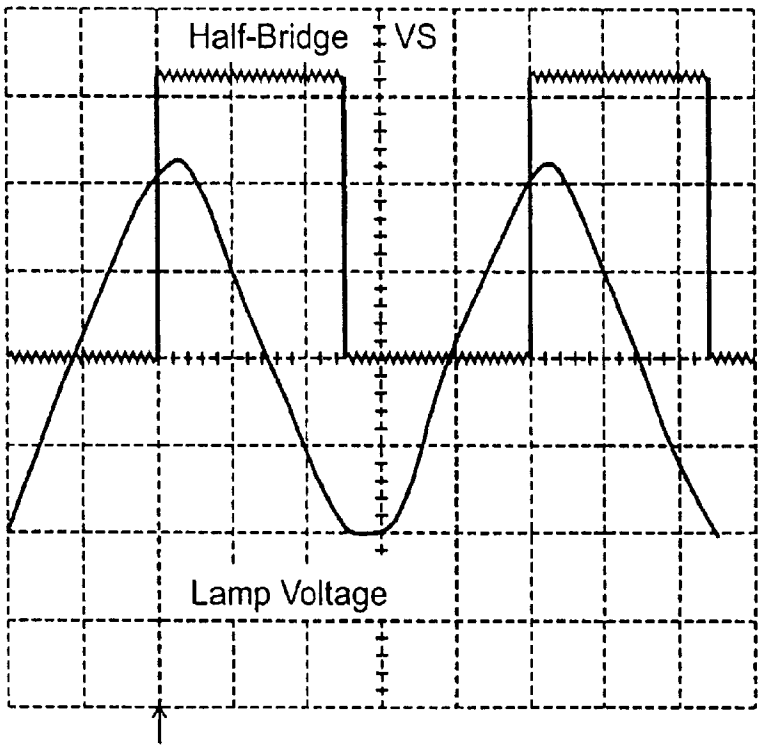
FIG. 14 shows the lamp voltage and half-bridge voltage during 100% brightness.
Figure 15:
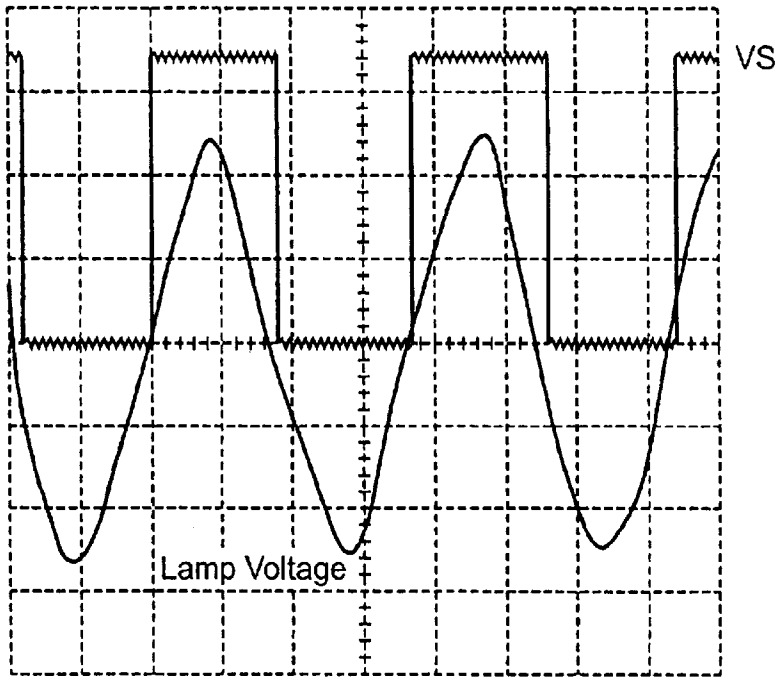
FIG. 15 shows the lamp voltage and half-bridge voltage during 10% brightness.

FIGS. 14 and 15 show lamp voltage and half bridge output VS during 100% brightness and 10% brightness, respectively. As shown, the phase angle of the lamp voltage with respect to current shifts. At low brightness, the phase angle between the voltage and current will be greater than at 100% brightness. Thus, during low brightness, reduced power is delivered to the lampload. The relationship between phase angle and power is shown in FIG. 5.

It is also possible to achieve dimming by applying a pulsed logic signal to the shut down (SD) pin of the controller IC. A typical frequency of this logic signal might be a few hundred Hz, e.g., 200 Hz, to avoid a perception of flickering to the human eye. The duty cycle of this logic signal will determine the on time of the lamp and therefore can be varied to control the dimming level. The dimming control of FIG. 10 can thus be controlled in several ways, e.g., by phase control or by duty cycle control of a signal at the SD input.

Although the present invention has been described in relation to particular embodiments thereof, many other variations and modifications and other uses will become apparent to those skilled in the art. Therefore, the present invention should be limited not by the specific disclosure herein, but only by the appended claims.

What is claimed is:

1. An electronic ballast for powering a cold cathode fluorescent lamp of an electronic display device and incorporated in the housing of the electronic display device, comprising:

a housing for the electronic display device, the electronic display device comprising a video display terminal; and an electronic ballast for powering a cold cathode fluorescent lamp, the cold cathode fluorescent lamp serving as an illumination device for the electronic display device; the ballast comprising:

a rectifier coupled to a source of AC power for producing a rectified DC output voltage;

a power factor correction circuit receiving the rectified DC output voltage and providing an increased voltage DC bus voltage, wherein said power factor correction circuit comprises a boost converter for providing said increased voltage DC voltage across said DC bus and power factor correction control circuit for controlling a switching operation of said boost converter;

an electronic switching circuit comprising at least one electronic switch for switching the DC bus voltage to provide a switched voltage for driving a cold cathode fluorescent lamp, the switched voltage being provided to the lamp through an output stage comprising a resonant LC circuit; and an electronic ballast control circuit for controlling a switching operation of said electronic switching circuit, and wherein said electronic ballast is fully contained in the housing for the electronic display device.

2. The electronic ballast of claim 1, further wherein said electronic ballast control circuit includes a dimming input.

3. An electronic ballast for powering a cold cathode fluorescent lamp of an electronic display device comprising:

a rectifier coupled to a source of AC power for producing a rectified DC output voltage;

a power factor correction circuit receiving the rectified DC output voltage and providing an increased voltage DC bus voltage;

an electronic switching circuit comprising at least one electronic switch for switching the DC bus voltage to provide a switched voltage for driving a cold cathode fluorescent lamp, the switched voltage being provided to the lamp through an output stage comprising a resonant LC circuit; and an electronic ballast control circuit for controlling a switching operation of said electronic switching circuit, and wherein said electronic ballast is provided in a housing for the electronic display device;

further wherein said electronic ballast control circuit includes a dimming input, wherein said dimming input establishes a reference phase angle and said electronic ballast control circuit further comprises a current sense input, said current sense input receiving a signal input related to an actual phase angle between current through said lamp and voltage across said lamp, said electronic ballast control circuit detecting said actual phase angle and generating an error signal proportional to the difference between the actual phase angle and the reference phase angle and driving said lamp to minimize the error signal, thereby driving the lamp to a desired dimming level set by said reference phase angle.

4. The electronic ballast of claim 3, wherein said power factor correction circuit comprises a boost converter for providing said increased voltage DC voltage across said DC bus and a power factor correction control circuit for controlling a switching operation of said boost converter.

5. The electronic ballast of claim 3, wherein said signal related to the actual phase angle is generated across a current sense resistance in series with said electronic switching circuit.

6. The electronic ballast of claim 5, wherein the electronic switching circuit comprises a half bridge switching circuit comprising a high side switch and a low side switch connected in series across said DC bus, said switched voltage being provided at a common connection of said high side and low side switches.

7. The electronic ballast of claim 6, wherein the resonant LC circuit comprises a series inductance and capacitance coupled in series with a primary of a step up transformer, the step up transformer having a secondary providing a stepped up voltage to said lamp.

8. The electronic ballast of claim 7, further comprising a parallel capacitance disposed in parallel to said lamp.

9. An electronic ballast for powering a cold cathode fluorescent lamp of an electronic display device and incorporated in the housing of the electronic display device, comprising:

a housing for the electronic display device, the electronic display device comprising a video display terminal; and an electronic ballast for powering a cold cathode fluorescent lamp, the cold cathode fluorescent lamp serving as an illumination device for the electronic display device; the ballast comprising:

a rectifier coupled to a source of AC power for producing a rectified DC output voltage;

a power factor correction circuit receiving the rectified DC output voltage and providing an increased voltage DC bus voltage, wherein said power factor correction circuit comprises a boost converter for providing said increased voltage DC voltage across said DC bus and a power factor correction control circuit for controlling a switching operation of said boost converter;

an electronic switching circuit comprising at least one electronic switch for switching the DC bus voltage to provide a switched voltage for driving a cold cathode fluorescent lamp, the switched voltage being provided to the lamp through an output stage comprising a resonant LC circuit; and an electronic ballast control circuit for controlling a switching operation of said electronic switching circuit, and wherein said electronic ballast is fully contained in the housing for the electronic display device;

said electronic ballast control circuit including a dimming input; and wherein the dimming input comprises a shut down pin of said electronic ballast control circuit, and a pulsed logic signal is applied to the shut down pin to control lamp brightness.

10. The electronic ballast of claim 9, wherein a duty cycle of said pulsed logic signal is varied to control the lamp brightness.

11. An electronic ballast for powering a cold cathode fluorescent lamp comprising:

a rectifier coupled to a source of AC power for producing a rectified DC output voltage;

a boost circuit receiving the rectified DC output voltage and providing an increased voltage DC bus voltage;

an electronic switching circuit comprising at least one electronic switch for switching the DC bus voltage to provide a switched voltage for driving a cold cathode fluorescent lamp, the switched voltage being provided to the lamp through an output stage comprising a resonant LC circuit; and an electronic ballast control circuit for controlling a switching operation of said electronic switching circuit; further wherein said electronic ballast control circuit includes a dimming input, the dimming input establishing a reference phase angle and said electronic ballast control circuit further comprises a current sense input, said current sense input receiving a signal related to the actual phase angle between current through said lamp and voltage across said lamp, said electronic ballast control circuit detecting said actual phase angle and generating an error signal proportional to the difference between the actual phase angle and the reference phase angle and driving said lamp to minimize the error signal, thereby driving the lamp to a desired dimming level set by said reference phase angle.

12. The electronic ballast of claim 11, wherein said boost circuit comprises a power factor correction circuit including a boost converter for providing said increased voltage DC voltage across said DC bus and a power factor correction control circuit for controlling a switching operation of said boost converter.

13. The electronic ballast of claim 11, wherein said input related to the actual phase angle is generated across a current sense resistance in series with said electronic switching circuit.

14. The electronic ballast of claim 13, wherein the electronic switching circuit comprises a half bridge switching circuit comprising a high side switch and a low side switch connected in series across said DC bus, said switched voltage being provided at a common connection of said high side and low side switches.

15. The electronic ballast of claim 14, wherein the resonant LC circuit comprises a series inductance and capacitance coupled in series with a primary of a step up transformer, the step up transformer having a secondary providing a stepped up voltage to said lamp.

16. The electronic ballast of claim 15, further comprising a parallel capacitance disposed in parallel to said lamp.

17. An electronic ballast for powering a cold cathode fluorescent lamp comprising:

a rectifier coupled to a source of AC power for producing a rectified DC output voltage;

a boost circuit receiving the rectified DC output voltage and providing an increased voltage DC bus voltage;

an electronic switching circuit comprising at least one electronic switch for switching the DC bus voltage to provide a switched voltage for driving a cold cathode fluorescent lamp, the switched voltage being provided to the lamp through an output stage comprising a resonant LC circuit; and an electronic ballast control circuit for controlling a switching operation of said electronic switching circuit; further wherein said electronic ballast control circuit includes a dimming input, further wherein said dimming input comprises a shut down pin of said electronic ballast control circuit, and a pulsed logic signal is applied to the shut down pin to control lamp brightness.

18. The electronic ballast of claim 17, wherein a duty cycle of said pulsed logic signal is varied to control the lamp brightness.

* * * * *